US005510964A

United States Patent [19]

Spitler et al.

[11] Patent Number: 5,510,964

[45] Date of Patent: Apr. 23, 1996

[54] LUMINAIRE INCLUDING A DOUBLE-ENDED LAMP AND MEANS FOR PROTECTING AGAINST ELECTRIC SHOCK DURING RELAMPING

[75] Inventors: Brian L. Spitler, Elon College; Suleyman O. Sumer, Chapel Hill, both of N.C.

[73] Assignee: Regent Lighting Corporation, Burlington, N.C.

[21] Appl. No.: 309,667

[22] Filed: Sep. 21, 1994

[51] Int. Cl.[6] ..... F21S 3/00

[52] U.S. Cl. ..... 362/217; 362/226; 439/232; 439/242

[58] Field of Search ..... 362/10, 217, 221, 362/226, 260, 390; 439/232, 226, 244, 242

[56] References Cited

U.S. PATENT DOCUMENTS 5,109,323 4/1992 Waycaster ..... 362/260 X

*Primary Examiner*—Stephen F. Husar

[57] ABSTRACT

This luminaire employs as its light source a double-ended lamp comprising a tubular light-transmitting envelope having a central longitudinal axis, conductive terminals at opposite ends of the envelope, and a light-generating filament connected between the terminals. The lamp, when installed in the luminaire, is connected between a pair of spaced contacts respectively engaging its conductive terminals. The luminaire is constructed in such a manner that an installer engaged in relamping it is blocked from accidentally touching one terminal of the lamp while the other terminal is engaged with its mating contact, thereby protecting the installer from such electric shock as could result from touching one lamp terminal while the other is engaged with a live contact.

7 Claims, 3 Drawing Sheets

LUMINAIRE INCLUDING A DOUBLE-ENDED LAMP AND MEANS FOR PROTECTING AGAINST ELECTRIC SHOCK DURING RELAMPING

TECHNICAL FIELD

This invention relates to a luminaire and, more particularly, to a luminaire that employs as a light source a double-ended incandescent lamp, e.g., a double-ended quartz halogen lamp.

BACKGROUND

The typical double-ended incandescent lamp comprises a tubular light-transmitting envelope having a central longitudinal axis, conductive terminals at opposite ends of the envelope, and a light-generating filament located within the envelope and connected between the terminals. The terminals of such lamp typically have concave surfaces that face axially outward with respect to the envelope. The luminaire that receives the lamp includes a housing and a reflector within the housing for aiming the light generated by the lamp when the lamp is installed. A pair of spaced-apart contacts are located within the housing and have convex portions adapted to respectively engage the concave surfaces of the lamp terminals when the lamp is installed within the luminaire. Each terminal of the lamp is provided with a sleeve of electrical insulation that covers all exterior surfaces of the terminal except for the outwardly-facing concave surface, which is slightly recessed from the outer end of the sleeve. The presence of the insulating sleeves and the recessed character of the concave surfaces reduce the chances that a live part of the terminals will be accidentally touched during relamping, and this reduces the chances for electric shock to the installer.

A luminaire of the above type should be disconnected before any relamping is attempted, and there is usually a caution notice on the luminaire that warns against the risk of electric shock if the luminaire is not disconnected during relamping. In the event that the warning notice is not heeded and the luminaire remains connected during relamping, a situation may arise where both terminals of the lamp are live during the relamping process even though only one terminal is in engagement with its mating contact in the luminaire. The insulating sleeve around the still disengaged terminal will normally prevent contact with this disengaged terminal, but there is a possibility that the recessed conductive portion of the still-disengaged terminal will be touched during relamping, and this could result in serious electric shock.

It is possible to reduce the possibilities of such electric shock by providing an interlock switch that automatically disconnects power to the contacts when the luminaire is opened for relamping. But such switches are not fool-proof and, moreover, they can be quite expensive, considering that they must usually be designed to withstand the high temperatures developed by the luminaire.

OBJECTS

An object of our invention is to provide, in a luminaire that includes a double-ended incandescent lamp, protective means that reduces the risk of electric shock to one relamping the luminaire but is able to accomplish this result without relying upon an interlock switch.

Another object is to construct the above type luminaire in such a manner that one engaged in relamping it is blocked from accidentally touching one terminal of the lamp while the other terminal is engaged with its mating contact.

SUMMARY

In carrying out the invention in one form, we provide a luminaire that uses as a light source a double-ended lamp of the type described above. The luminaire comprises a housing containing a light-emitting opening at one side through which the lamp is installed. Within the housing at spaced locations is a pair of contacts having projecting portions adapted to respectively engage the outwardly-facing surfaces of the lamp terminals. Spring means urges the contacts into engagement with the outwardly-facing terminal surfaces when the lamp is installed. Around each contact is a socket of insulating material, and about each socket is a casing that includes sidewalls at opposite sides of the socket and an end region through which the installed lamp is adapted to extend. Adjacent one sidewall of one casing is a cavity into which one terminal of the lamp can be inserted to position said one terminal laterally adjacent the socket in said one casing, following which the other lamp terminal can be inserted into the other of the sockets to engage the contact in said other socket while said one terminal is positioned within said cavity, following which a compressive force directed axially of the lamp envelope can be applied to the envelope to retract the contact engaging said other terminal against the bias of the spring means, and said one terminal can be shifted laterally into engagement with its associated contact while the other terminal remains engaged with its retracted associated contact. Each of the casings is provided with a barrier (i) facing the light-emitting opening of the luminaire, (ii) positioned between the associated socket and the light-emitting opening, and (iii) constructed to block the conductive lamp terminals from engaging their associated contacts during lamp installation unless one lamp terminal is first positioned in said cavity. One of the barriers covers the cavity sufficiently to block access by an installer to the cavity when said one lamp terminal is positioned therein.

BRIEF DESCRIPTION OF FIGURES

For a better understanding of the invention, reference may be had to the following detailed description taken in conjunction with the accompanying drawings, in which.

DETAILED DESCRIPTION OF EMBODIMENT

Figure 1:
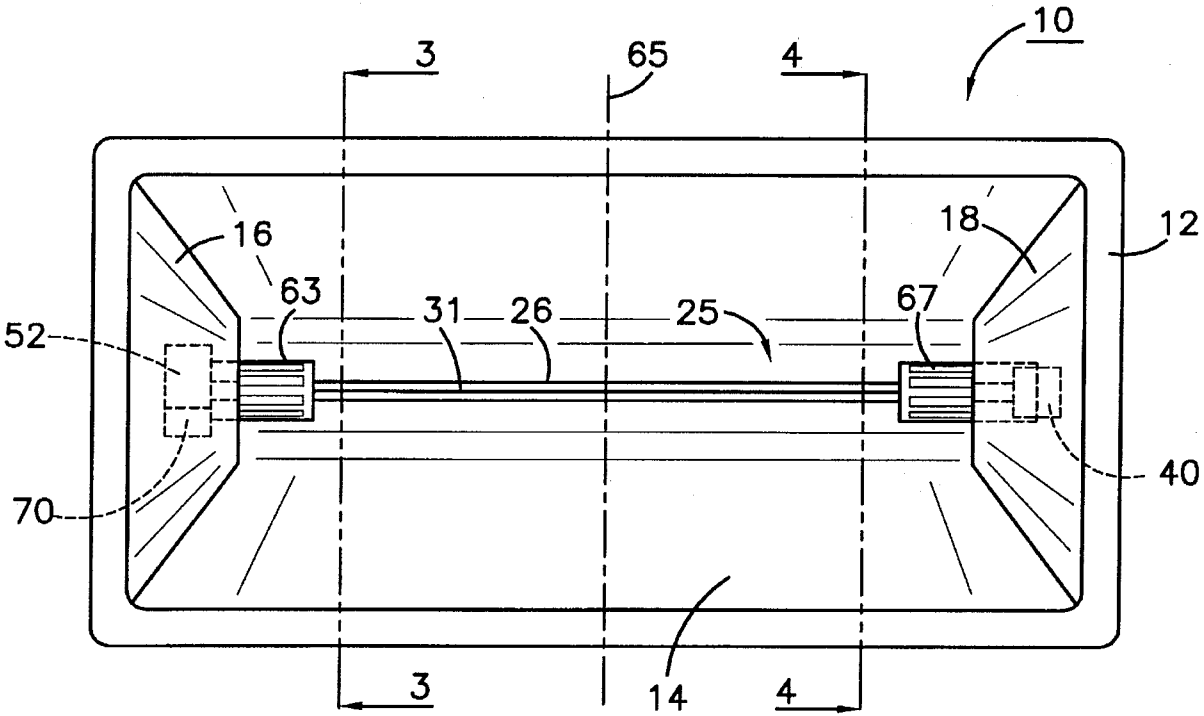
FIG. 1 is a front view of a luminaire embodying one form of the invention.
Figure 3:
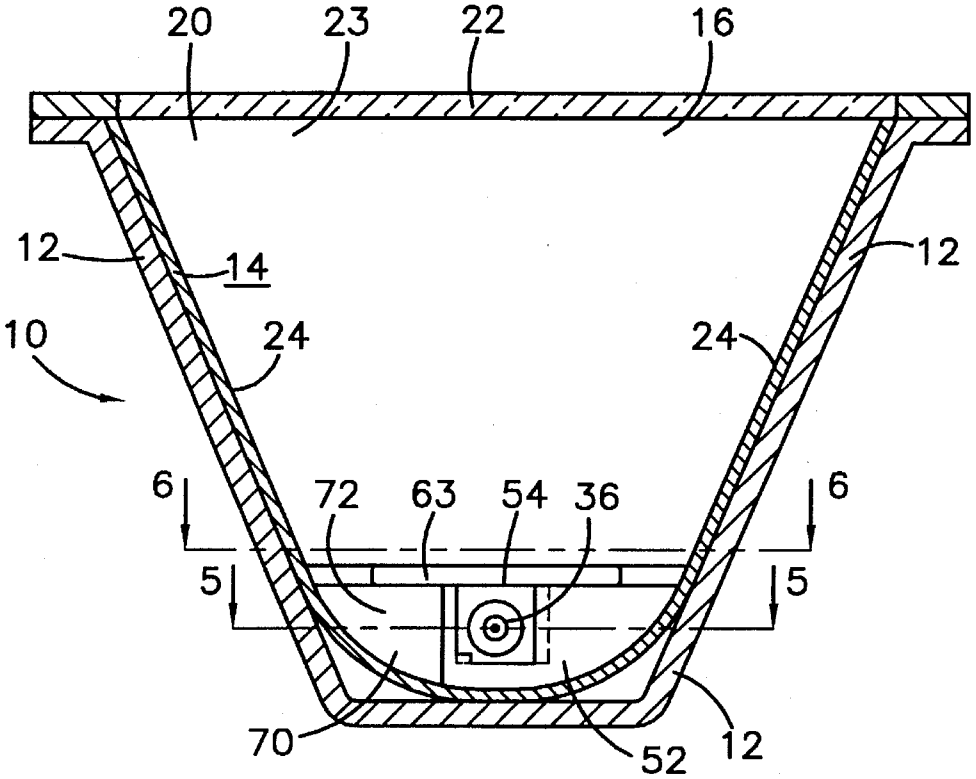
FIG. 3 is an enlarged sectional view taken along the line 3—3 of FIG. 1.

Referring now to FIGS. 1 and 3, the luminaire 10 shown therein comprises a trough-like housing 12 having a generally U-shaped transverse cross-section. Suitably mounted within the housing 12 is a reflector 14 also of generally U-shaped transverse cross-section having end walls 16 and 18 at its opposite ends. The housing 12 has a large opening 20 at its front side, and this opening is covered by a transparent lens 22. The reflector 14 also has an opening 23 at one of its sides, which opening registers with the opening 20 in the housing. As seen in FIG. 3, the sidewalls 24 of the reflector 14 follow convergent paths in extending from the front to the back of the luminaire housing 12. As seen in FIG. 1, the end walls 16 and 18 of the reflector also follow convergent paths in extending from the front to the back of the luminaire housing 12.

Figure 2:
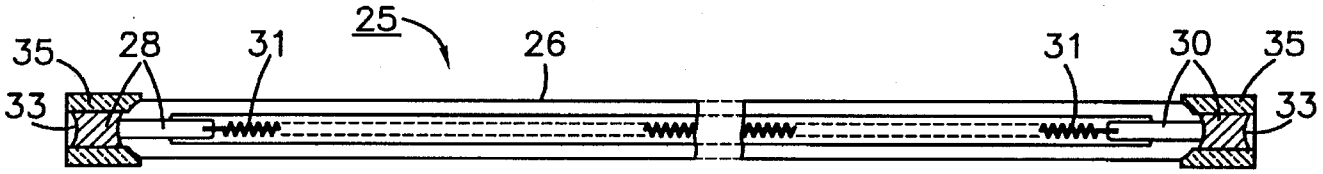
FIG. 2 is an enlarged sectional view of a double-ended quartz-halogen lamp used as the light source for the luminaire of FIG. 1.

The luminaire employs as its light source a double-ended, quartz-halogen lamp 25 best shown in FIGS. 1 and 2. This lamp, which is of a conventional construction, comprises a tubular envelope 26 of light-transmitting material, e.g., quartz. At opposite ends of the envelope are conductive terminals 28 and 30 to which the envelope is suitably sealed. Extending between the terminals 28 and 30 along the central longitudinal axis of the envelope 26 is a filament 31 of refractory metal such as tungsten. Each terminal 28 and 30 has a portion located outside the envelope 26, which portion includes at its outer end a concave surface 33 that faces outwardly of the envelope. The portions of the terminals outside the envelope except for their concave outer surfaces 33 are completely covered by sleeves 35 of electrical insulation. The concave surfaces 33 are slightly recessed from the outer ends of the insulating sleeves 35.

Figure 7:
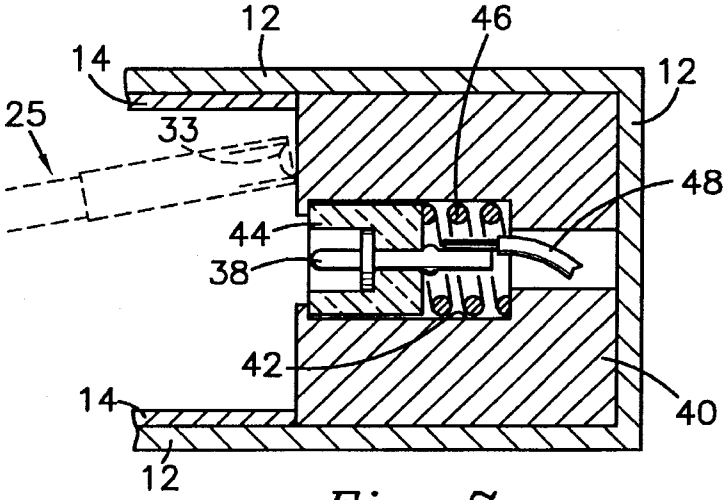
FIG. 7 is an enlarged sectional view taken along the line 7—7 of FIG. 4.
Figure 5:
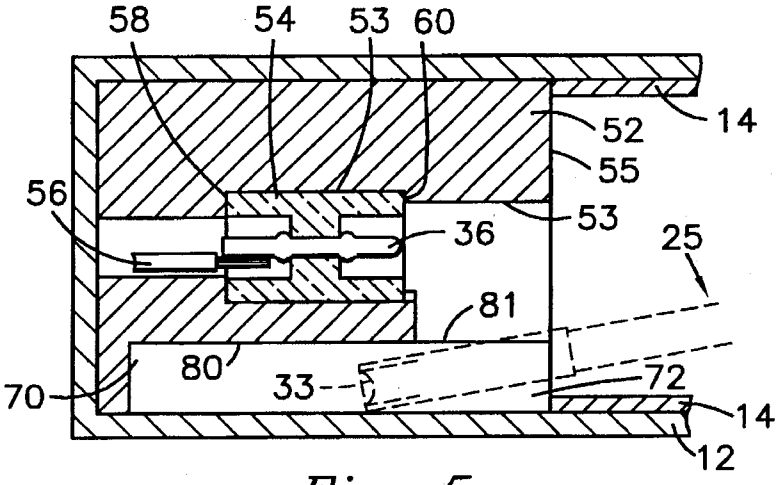
FIG. 5 is an enlarged sectional view taken along the line 5—5 of FIG. 3.

For connecting the lamp 25 into the electrical circuit that extends through the luminaire, there are provided at opposite ends of the luminaire housing 12 of FIG. 1 a pair of rod-shaped contacts 36 and 38, best shown in FIGS. 5 and 7, respectively. These contacts have convex surfaces at their inner ends that are adapted to engage the concave surfaces 33 of the lamp terminals when the lamp is installed in the luminaire. Referring to FIG. 7, the mounting means for right-hand contact 38 comprises a metallic casing 40 that is integral with the luminaire housing 12 and contains a bore 42 in which contact 38 is located. A porcelain socket 44 surrounds the contact 38, is fixed to the contact 38, and is slidably mounted within the bore 42. The porcelain socket 44 has a rectangular outer periphery, and the bore 42 is of a mating rectangular cross-section that allows the socket to slide axially within the bore. The socket 44 and the contact 38 are biased to the left, as shown in FIG. 7, by a compression spring 46 located between the right-hand end of the socket and an end wall of the casing 40. At its right hand end, the contact 38 is connected to an insulated wire 48 that is part of the circuit through the luminaire.

Referring to FIG. 5, the other rod-shaped contact 36 is mounted in a casing 52 that is integral with housing 12 of the luminaire and contains a bore 53 in which the contact 36 is located. A porcelain socket 54 surrounds the rod-shaped contact 36 and is fixed to contact 36. At its left hand end the rod-shaped contact 36 is connected to an insulated wire 56 that is part of the circuit through the luminaire. Socket 54 has a rectangular outer periphery, and the bore 53 has a mating rectangular cross-section for receiving the outer periphery of the socket. Spaced-apart shoulders 58 and 60 in the bore 53 are located at opposite sides of the socket and act to hold the socket against axial movement within the bore. These shoulders position the socket in a location spaced from the front end 55 of the casing 52.

Figure 6:
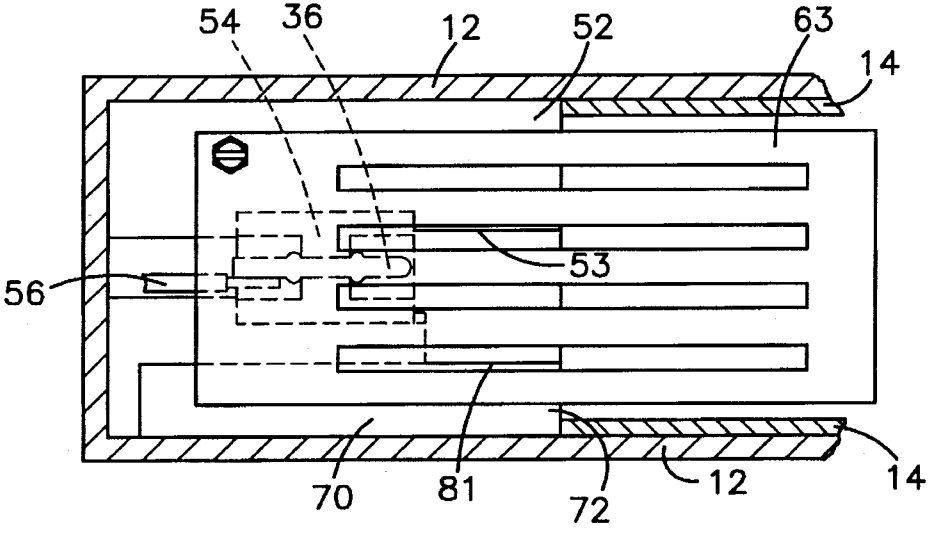
FIG. 6 is an enlarged sectional view taken along the line 6—6 of FIG. 3.

The casings 40 and 52 in which the contacts 36 and 38 are mounted are located near the back side of the luminaire housing. The end walls 16 and 18 of the reflector 14 are positioned between these casings and the open front side of the reflector. As shown in FIGS. 1, 3, and 6, mounted on one of the casings 52 and positioned between the casing 52 and the front side of the housing 12 is a barrier plate 63 that extends from a location behind the reflector end wall 16 toward the central plane 65 of the luminaire to a location spaced inwardly of the reflector end wall 16. This barrier plate 63 restricts access to the contact 36 behind it and provides other safety functions soon to be described.

Figure 4:
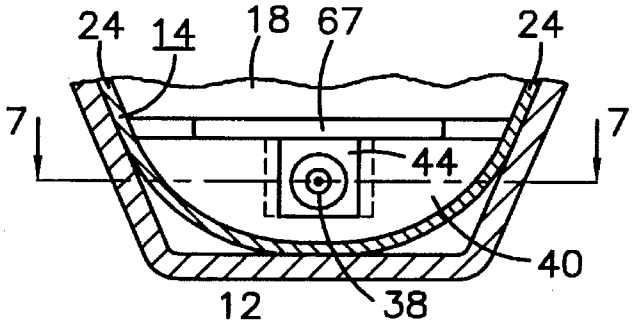
FIG. 4 is an enlarged sectional view taken along the line 4—4 of FIG. 1.

As shown in FIGS. 1 and 4, on the other casing 40 is a similar barrier plate 67 that restricts access to the contact 38 behind this barrier plate. The barrier plate 67 is fixed to casing 40 at a location behind the reflector end wall 18 and extends from that location past the reflector end wall 18 toward the central plane 65 of the luminaire, terminating a short distance from the reflector end wall 18. The two barrier plates 63 and 67,by restricting access to the contacts 36 and 38 located behind them, help to protect against accidental touching of these contacts by one engaged in relamping or otherwise servicing the luminaire.

As shown in FIGS. 3, 5, and 6, between the casing 52 and one sidewall of the luminaire housing 12 is a cavity 70 having an open end 72 facing toward the central plane 65 of the luminaire. The front of this cavity 70 is partially covered by the barrier plate 63, and the barrier plate serves to restrict access to the cavity for reasons soon to be described. Despite the presence of barrier plate 63, the open end 72 of the cavity 70 is still free of obstruction. Referring to FIG. 5, it is to be noted that the cavity 70 communicates with the front portion of the bore 53 through a lateral opening 81 in the front region of the cavity that is located behind barrier plate 63.

INSTALLATION AND REMOVAL OF LAMP 25

The lamp 25 is installed in the luminaire in the following manner. First, the installer grasps the lamp centrally of the quartz envelope, and then he inserts the left-hand end of the lamp into the cavity 70 through its open end 72. At this time, the left-hand terminal of the lamp is positioned behind the barrier plate 63 and adjacent the sidewall 80 of the casing 52, as shown by dotted lines in FIG. 5. The right-hand end of the lamp is then positioned, as shown by dotted lines in FIG. 7, in a position behind barrier plate 67 (of FIG. 1). Thereafter, the installer shifts the right-hand end of the lamp downwardly (as viewed in FIG. 7) until the exposed concave end 33 of the right-hand terminal engages the convex end of the right-hand contact 38. Such shifting of the right-hand end of the lamp causes the left-hand end of the lamp to move slightly further into the cavity 70. Then the installer applies to the lamp envelope a compressive force that pushes the right-hand end of the lamp toward the right (as viewed in FIG. 7) and drives the right-hand contact 38 to the right, retracting contact 38 against the opposing bias of spring 46. This motion of the lamp shifts its left-hand end to the right (as viewed in FIG. 5) sufficiently to allow the left-hand end to clear the sidewall 80 of casing 52, thus allowing the left-hand end of the lamp to be shifted laterally through opening 81 into a position where the concave end 33 of the left-hand lamp terminal engages the convex end of left-hand contact 36. The longitudinal axis of the lamp is then lined up with the contacts 36 and 38, and the compression spring 46 is then acting to apply pressure for holding the contacts in engagement with the concave surfaces on the lamp terminals. At this time, the lamp is fully installed and the installer can then release the lamp.

Removal of the lamp is effected by reversing the above-described steps. That is, the installer grasps the lamp centrally of the envelope 26 and forces it to the right to compress spring 46 and disengage the left-hand terminal 28 from the left-hand socket contact 36. He then laterally shifts the left-hand end of the lamp through opening 81 into cavity 70 (as viewed in FIG. 5), following which he moves the left-hand end further into the cavity 70 to disengage the right-hand lamp terminal from contact 38. He then shifts the right-hand end of the lamp into its dotted line position of FIG. 7, following which he withdraws the lamp from the luminaire housing.

To reduce the risk of electric shock to the installer, it is important that the luminaire be disconnected from its power supply prior to installation or removal of the lamp, i.e., before relamping. The luminaire is provided with an appropriate caution notice warning about this risk.

An object of our invention is to protect the installer from electric shock even if he fails to heed the above notice and does not disconnect the luminaire before relamping. To this end, with the barrier plates 63 and 67 in place, the installer engaged in installing the lamp 25 is blocked from engaging either terminal 28 or 30 of the lamp with its associated contact 36 or 38 unless he follows the lamp-installation procedure described above. More specifically, the luminaire and its barrier plates 63 and 67 are so dimensioned that neither terminal 28 or 30 of the lamp can be engaged with its associated contact unless one end of the lamp is first inserted into the cavity 70 of FIGS. 5 and 6. If the one lamp end (e.g., the one including terminal 28) is first inserted into the cavity 70, the installer is blocked by barrier plate 63 from accidentally touching the terminal 28 while he is engaging the other terminal with its contact 38. The insulating sleeve 35 around the terminal 28 also helps to block accidental touching of terminal 28 during lamp installation.

If the contact 38 was live during installation of the lamp and the installer could engage lamp terminal 30 with it while the other lamp terminal (28) was exposed, there would be a risk of electric shock if the installer contacted the other terminal (28) since this other lamp terminal would also be live due to the connection of the terminals through filament 31. We greatly reduce the possibility that a live part of terminal 28 will be accidentally touched under such circumstances because the barrier plate 63 and insulating sleeve 35 shield the terminal 28 from exposure during this interval.

Similarly, during lamp removal the left hand end of the lamp is shielded from accidental contact with the installer by the presence of the barrier plate 63 and the insulating sleeve 35 and by reason of the fact that the left-hand end of the lamp must be shifted into cavity 70 while the right-hand end of the lamp is being disengaged from its contact 38.

It is to be noted that during installation of the lamp, the left-hand end of the lamp is blocked from being shifted laterally from its dotted line position of FIG. 5 into engagement with contact 36 unless the right-hand end of the lamp has first been shifted into engagement with its associated contact 38 and pressed against contact 38 to retract contact 38 against spring 46. As a result, the left-hand terminal of the lamp is blocked from becoming live before the right-hand terminal, thus protecting the installer from shock should he attempt to engage the left-hand terminal before the right-hand terminal without first disconnecting the luminaire.

A feature of the luminaire that aids in blocking the installer from prematurely engaging either terminal of the lamp with its mating contact 36 or 38 is the configuration of the luminaire reflector 14. Because the sidewalls 24 of the reflector converge toward the back of the reflector and the end walls 16 and 18 of the reflector converge toward the back of the reflector, the dimensions of the luminaire in this back region are quite restricted relative to the length dimension of the lamp. These restrictive dimensions result in the presence of structure in the back region interfering with positioning the lamp in such a way that either of its terminals can be made to engage the contacts unless the above-described installation procedure is followed, i.e., the left-hand terminal of the lamp must be inserted into the cavity 70 before the right-hand terminal is shifted into engagement with its mating contact 38. This interfering structure is insulated from the power circuit through the luminaire, i.e., it is electrically dead even when the contacts 36 and 38 are energized.

While we have shown and described a particular embodiment of our invention, it will be obvious to those skilled in the art that various changes and modifications may be made without departing from our invention in its broader aspects;and we, therefore, intend herein to cover all such changes and modifications as fall within the true spirit and scope of our invention.

What we claim as new and desire to secure by Letters Patent of the United States is:

1. In a luminaire that is adapted to employ as a light source a double-ended lamp comprising a tubular light-transmitting envelope having a central longitudinal axis, conductive terminals at opposite ends of the envelope, and a light-generating filament located within said envelope and connected between said terminals, the terminals having surfaces that face axially outward of the envelope, the combination of:

(a) a luminaire housing containing a light-emitting opening at one side through which said lamp is installed, (b) a pair of contacts disposed at spaced-apart locations within said housing and having portions adapted to respectively engage said outwardly-facing surfaces of said lamp terminals when the lamp is installed within said luminaire, (c) spring means for urging said contacts into engagement with said outwardly-facing terminal surfaces when the lamp is installed within said luminaire, (d) a socket of insulating material around each contact, (e) a pair of casings respectively disposed about said sockets, each casing including sidewalls at opposite sides of the associated socket and an end region through which said lamp is adapted to extend when installed within said luminaire, and in which:

(f) said luminaire includes a cavity adjacent one sidewall of one of said casings into which one terminal of the lamp can be inserted during lamp installation to position said one terminal laterally adjacent the socket in said one casing, following which the other lamp terminal can be inserted into the other of said sockets to engage the contact within said other socket while said one terminal is positioned within said cavity, following which a compressive force directed axially of said lamp envelope can be applied to said lamp envelope to retract the contact engaging said other terminal against the bias of said spring means, following or during which said one terminal can be shifted laterally into engagement with its associated contact while said other terminal remains in engagement with its retracted associated contact, and (g) each casing is provided with a barrier (i) facing the light-emitting opening of the luminaire, (ii) positioned between the associated socket and said light-emitting opening, and (iii) constructed to block the conductive lamp terminals from engaging their associated contacts during lamp installation unless one lamp terminal is first positioned in said cavity, and (h) one of said barriers covers said cavity sufficiently to block access by an installer to said cavity when said one lamp terminal is positioned therein.

2. A luminaire as defined in claim 1 in which said barriers are positioned and constructed to block installation of the lamp except in substantially the manner defined in paragraph (f) of claim 1.

3. The luminaire of claim 1 in which the lamp employed therein includes electrical insulation covering said terminals except for said outwardly-facing surfaces of said terminals.

4. The luminaire of claim 1 in which: said contacts are located near the back of said luminaire housing, said luminaire contains a reflector for reflecting light from said lamp through said light-emitting opening, said reflector has sidewalls that converge toward the back of said luminaire housing and end walls that converge toward the back of said luminaire housing, and interfering structure is present near the back of the luminaire housing that blocks the conductive terminals of said lamp from engaging either of said contacts during lamp installation unless one terminal is first inserted into said cavity, said interfering structure is electrically-dead even if the luminaire contacts are energized.

5. A luminaire as defined in claim 1 and including interfering structure that blocks the conductive terminals of said lamp from engaging either of said contacts during lamp-installation unless one conductive terminal is first inserted into said cavity, said interfering structure being electrically-dead even if the luminaire contacts are energized.

6. A luminaire is defined in claim 1 in which said cavity contains a lateral opening (81) behind said one barrier through which said one terminal can be moved when shifted laterally from said cavity into engagement with its associated contact during lamp-installation.

7. A luminaire is defined in claim 1 in which, during lamp-installation, said one terminal is blocked from becoming live before said other terminal should an installer attempt to engage said one terminal with its associated contact before engaging said other terminal with its associated contact should both contacts be live during attempted lamp-installation.

* * * * *